US005782031A

United States Patent [19]

Bourgeois

[11] Patent Number: 5,782,031

[45] Date of Patent: Jul. 21, 1998

[54] FIREARM PIERCING TOOL ATTACHMENT DEVICE

[76] Inventor: Mario H. Bourgeois, 605 Boundary Road, Alfred, Ontario K0B 1A0, Canada

[21] Appl. No.: 881,837

[22] Filed: Jun. 25, 1997

[51] Int. Cl.[6] ..... F41A 15/00

[52] U.S. Cl. ..... 42/90

[58] Field of Search ..... 42/90, 95, 106, 42/85; 81/121.1

[56] References Cited

U.S. PATENT DOCUMENTS

| | | | |
|---|---|---|---|
| 1,197,079 | 9/1916 | Townsend | 42/90 |
| 1,251,247 | 12/1917 | Lanfranco | 42/90 |
| 2,409,916 | 10/1946 | Varcoe | 42/95 |
| 2,544,847 | 3/1951 | Malesky | 42/95 |
| 3,480,982 | 12/1969 | Saunders | 42/90 |
| 4,069,586 | 1/1978 | Skelton | 30/366 |
| 4,087,912 | 5/1978 | Granone | 30/366 |
| 4,129,188 | 12/1978 | El-Souessi et al. | 173/120 |
| 4,713,886 | 12/1987 | Ikeda | 30/366 |
| 5,426,858 | 6/1995 | Clark et al. | 30/367 |
| 5,685,102 | 11/1997 | Latka | 42/90 |

*Primary Examiner*—Charles T. Jordan
*Assistant Examiner*—Theresa M. Wesson

[57] ABSTRACT

A new Firearm Piercing Tool Attachment Device for attaching a piercing tool to a firearm having a cleaning port. The inventive device includes a body having a hollow section and a second section, the second section being receivable within the cleaning port of the firearm, a spring-biased pin disposed within the second section for removably attaching the second section to the cleaning port, and a plurality of retaining set screws for removably attaching the piercing tool handle to the hollow section.

6 Claims, 2 Drawing Sheets

FIREARM PIERCING TOOL ATTACHMENT DEVICE

BACKGROUND OF THE INVENTION

1. Field of the Invention

The present invention relates to piercing tools and more particularly pertains to a new Firearm Piercing Tool Attachment Device for attaching a piercing tool to a fire arm having a cleaning port.

2. Description of the Prior Art

The use of piercing tools is known in the prior art. More specifically, piercing tools heretofore devised and utilized are known to consist basically of familiar, expected and obvious structural configurations, notwithstanding the myriad of designs encompassed by the crowded prior art which have been developed for the fulfillment of countless objectives and requirements.

Known prior art piercing tools include U.S. Pat. No. 4,087,912; U.S. Pat. No. 4,069,586; U.S. Pat. No. 4,713,886; U.S. Pat. No. 5,426,858; and U.S. Pat. No. 4,129,188.

While these devices fulfill their respective, particular objectives and requirements, the aforementioned patents do not disclose a new Firearm Piercing Tool Attachment Device. The inventive device includes a body having a hollow section and a second section, the second section being receivable within the cleaning port of the firearm, a means for removably attaching the second section to the cleaning port, and a means for removably attaching the piercing tool to the hollow section.

In these respects, the Firearm Piercing Tool Attachment Device according to the present invention substantially departs from the conventional concepts and designs of the prior art, and in so doing provides an apparatus primarily developed for the purpose of attaching a piercing tool to a firearm having a cleaning port.

SUMMARY OF THE INVENTION

In view of the foregoing disadvantages inherent in the known types of piercing tools now present in the prior art, the present invention provides a new Firearm Piercing Tool Attachment Device construction wherein the same can be utilized for attaching a piercing tool to a firearm having a cleaning port.

The general purpose of the present invention, which will be described subsequently in greater detail, is to provide a new Firearm Piercing Tool Attachment Device apparatus and method which has many of the advantages of the piercing tools mentioned heretofore and many novel features that result in a new Firearm Piercing Tool Attachment Device which is not anticipated, rendered obvious, suggested, or even implied by any of the prior art piercing tools, either alone or in any combination thereof.

To attain this, the present invention generally comprises a body having a hollow section and a second section, the second section being receivable within the cleaning port of the firearm, a means for removably attaching the second section to the cleaning port, and a means for removably attaching the piercing tool to the hollow section.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Firearm Piercing Tool Attachment Device apparatus and method which has many of the advantages of the piercing tools mentioned heretofore and many novel features that result in a new Firearm Piercing Tool Attachment Device which is not anticipated, rendered obvious, suggested, or even implied by any of the prior art piercing tools, either alone or in any combination thereof.

It is another object of the present invention to provide a new Firearm Piercing Tool Attachment Device which may be easily and efficiently manufactured and marketed.

It is a further object of the present invention to provide a new Firearm Piercing Tool Attachment Device which is of a durable and reliable construction.

An even further object of the present invention is to provide a new Firearm Piercing Tool Attachment Device which is susceptible of a low cost of manufacture with regard to both materials and labor, and which accordingly is then susceptible of low prices of sale to the consuming public, thereby making such Firearm Piercing Tool Attachment Device economically available to the buying public.

Still yet another object of the present invention is to provide a new Firearm Piercing Tool Attachment Device which provides in the apparatuses and methods of the prior art some of the advantages thereof, while simultaneously overcoming some of the disadvantages normally associated therewith.

Still another object of the present invention is to provide a new Firearm Piercing Tool Attachment Device for attaching a piercing tool to a firearm having a cleaning port.

Yet another object of the present invention is to provide a new Firearm Piercing Tool Attachment Device which includes a body having a hollow section and a second section, the second section being receivable within the cleaning port of the firearm, a means for removably attaching the second section to the cleaning port, and a means for removably attaching the piercing tool to the hollow section.

Still yet another object of the present invention is to provide a new Firearm Piercing Tool Attachment Device that when utilized allows an officer of the law to keep both of his hands on the firearm while using the piercing tool to shatter the window of a vehicle thereby giving the officer a clear and undistorted view of a suspect inside the vehicle and further allowing for a positive identification of the suspect. Without the use of the Firearm Piercing Tool Attachment Device an officer has to use one hand to break the window thereby reducing his effectiveness.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
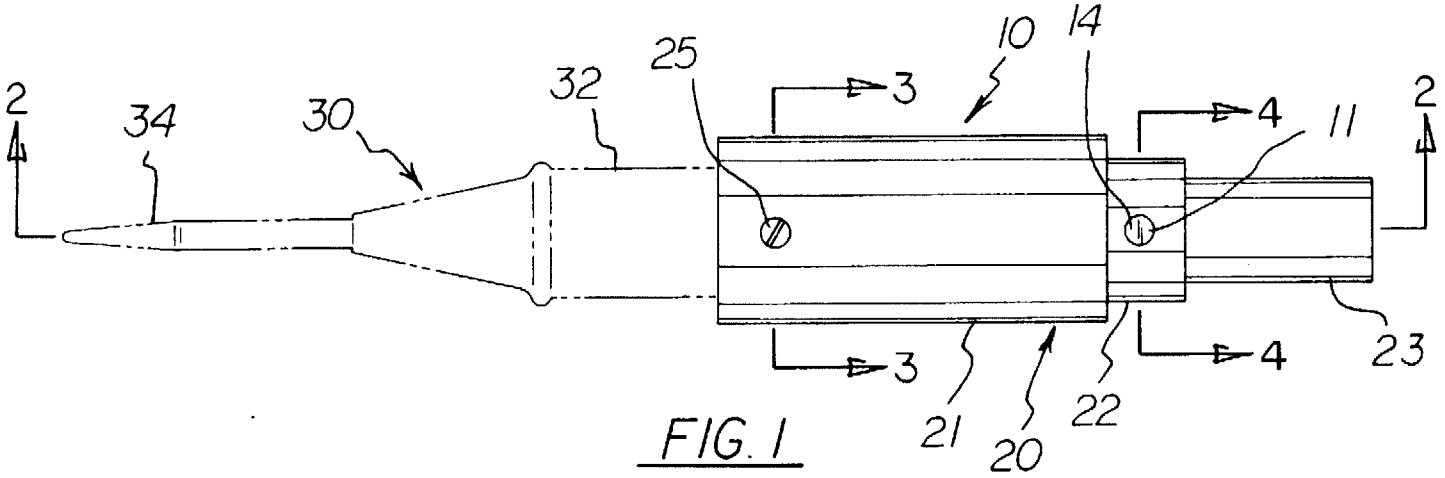
FIG. 1 is a plan view of a new Firearm Piercing Tool Attachment Device according to the present invention showing the piercing tool attached.

With reference now to the drawings, and in particular to FIGS. 1 through 4 thereof, a new Firearm Piercing Tool Attachment Device embodying the principles and concepts of the present invention and generally designated by the reference numeral 10 will be described.

More specifically, it will be noted that the Firearm Piercing Tool Attachment Device 10 comprises a body 20 having a hollow section 21 for receiving therein a handle 32 of a piercing tool 30 and a second section 22 receivable within a cleaning port of a firearm, a means for removably attaching the second section 22 to the cleaning port and a means for removably attaching the piercing tool 30 to the hollow section 21.

With reference to FIG. 1 there is shown the body 20 including the hollow section 21. The body is preferably manufactured of aluminum. The second section 22 is shown disposed intermediate the hollow section 21 and an extension 23, the extension 23 adding further retention support to the body 20 when the piercing tool 30 is disposed within the cleaning port.

With continued reference to FIG. 1 the piercing tool 30 is shown attached to the body 20. The handle 32 is shown received in the hollow section 21 and secured therein by a plurality of retaining set screws 25. The piercing tool 30 further includes a tip portion 34. The piercing tool 30 is preferably of the automatic type such as the Automatic Center Punch manufactured by Starrett.

Figure 2:
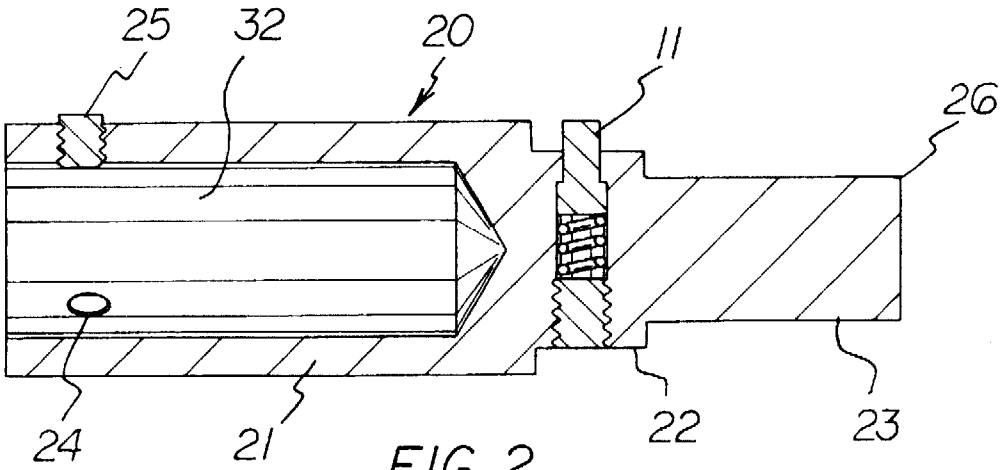
FIG. 2 is a cross sectional view thereof taken along line 2—2 of FIG. 1.
Figure 3:
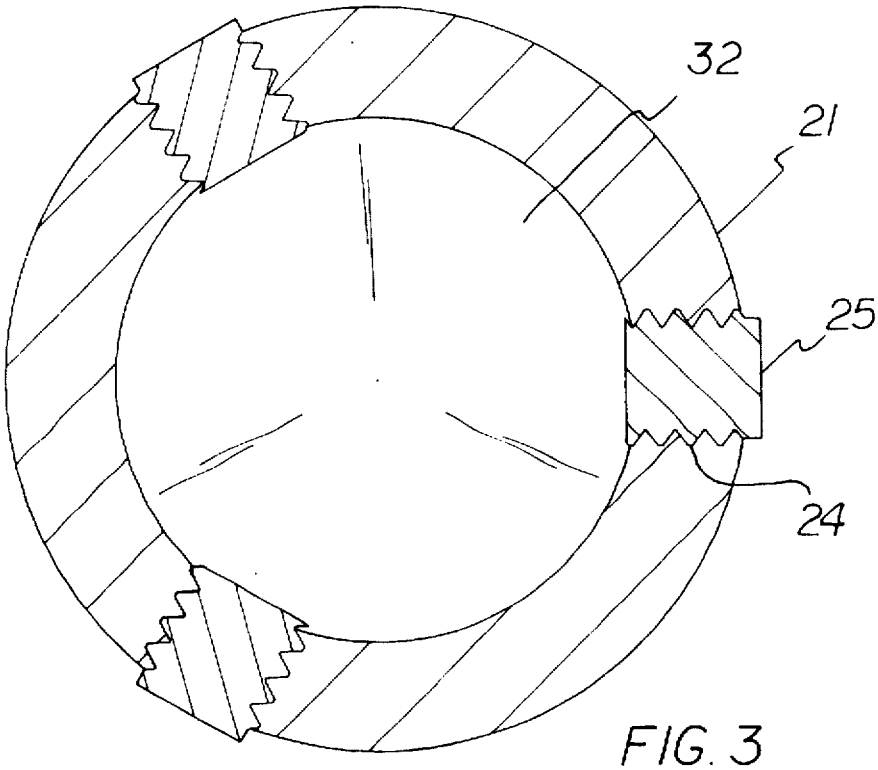
FIG. 3 a cross sectional view taken along line 3—3 of FIG. 1.

With reference to FIG. 2 there is shown the body 20 including a pin 11 shown disposed in the second section 22. A plurality of threaded bores 24 are shown disposed around the periphery of the hollow section 21 for receiving the plurality of retaining set screws 25 which frictionally engage the handle 32 of the piercing tool 30 when the handle 32 is disposed within the hollow section 21 (FIG. 3).

Figure 4:
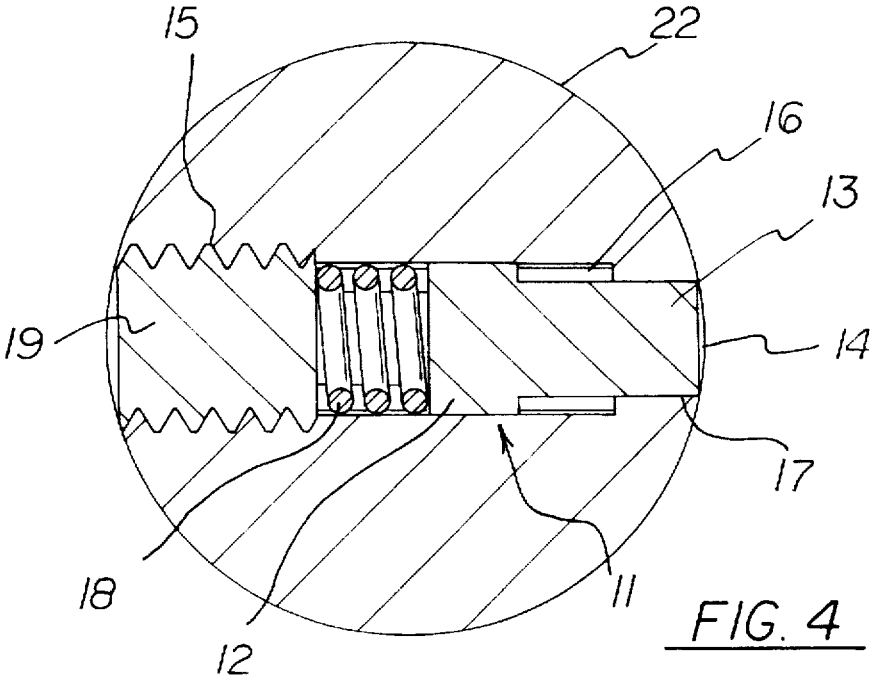
FIG. 4 is a cross sectional view taken along line 4—4 of FIG. 1.

With reference to FIG. 4 there is shown a means for removably attaching the second section 22 to the cleaning port of the firearm. A spring-biased pin 11 is shown disposed within a bore 14 formed in the second section 22. The spring-biased pin 11 is receivable within an aperture formed through the cleaning port for removably attaching the second section 22 to the cleaning port.

The bore 14 is shown having a threaded section 15 for receiving a set screw 19, a first unthreaded section 16 and a second unthreaded section 17 of lesser peripheral dimension than the first unthreaded section 16. The first unthreaded section 16 is shown disposed intermediate the threaded section 15 and the second uthreaded section 17. The spring-biased pin 11 is shown having a first portion 12 slidably disposed within the first unthreaded section 16 and a second portion 13 slidably disposed within the second unthreaded section 17. The first portion 12 is shown having a lesser longitudinal dimension than the first unthreaded section. The spring-biased pin 11 is biased in an extended position by a spring 18 disposed within the first unthreaded section 16 between the set screw 19 and the first portion 12.

By way of illustration only, in use with a 9 mm Heckler and Koch MP-5, the Firearm Piercing Tool Attachment Device of the present invention is attached to the cleaning port of the firearm by first removing the cap covering the cleaning port and inserting the body 20 into the cleaning port and securing it therein by means of the spring-biased pin 11 which engages an aperture formed in the wall of the cleaning port. The piercing tool 30 is attached to the hollow section 21 of the body 20 by means of retaining set screws 25 which frictionally engage the handle 32 of the piercing tool 30.

Once attached to the firearm, the tip portion 34 of the piercing tool 30 can be brought into contact with the window glass of the vehicle. Depending upon the type of piercing tool 30 employed, sufficient pressure is exerted by the officer to activate the piercing tool 30 and break the window glass.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope the invention.

What is claimed as being new and desired to be protected by Letters Patent of the United States is as follows:

1. A Firearm Piercing Tool Attachment Device for attaching a piercing tool having a handle to a firearm having a cleaning port including an aperture formed therethrough, the attachment device comprising:

a body having a hollow section and a second section, the second section being receivable within the cleaning port of the firearm;

a means for removably attaching the second section to the cleaning port; and a means for removably attaching the piercing tool to the hollow section.

2. The Firearm Piercing Tool Attachment Device of claim 1, wherein the means for removably attaching the second section to the cleaning port further comprise a spring-biased pin disposed within a bore formed in the second section, the spring-biased pin being receivable within the aperture.

3. The Firearm Piercing Tool Attachment Device of claim 2, wherein the bore further comprises a threaded section for receiving a set screw, a first unthreaded section and a second unthreaded section of lesser peripheral dimension than the first unthreaded section, the first unthreaded section being disposed intermediate the threaded section and the second unthreaded section, and wherein the spring-biased pin further comprises a first portion slidably disposed within the first unthreaded section and a second portion slidably disposed within the second unthreaded section, the first portion being of lesser longitudinal dimension than the first unthreaded section, the spring-biased pin being biased in an extended position by a spring disposed within the first unthreaded section between the set screw and the first portion.

4. The Firearm Piercing Tool Attachment Device of claim 1, wherein the second section further comprises an extension integrally formed thereon.

5. The Firearm Piercing Tool Attachment Device of claim 1, wherein the means for removably attaching the piercing tool to the hollow section further comprise a plurality of threaded bores formed around the periphery of the hollow section for receiving a retaining set screw, each retaining set screw frictionally engageable to the handle when the handle is disposed within the hollow section.

6. A Firearm Piercing Tool Attachment Device for attaching a piercing tool having a handle to a firearm having a cleaning port including an aperture formed therethrough, the attachment device comprising:

a body having a hollow section and a second section having an extension integrally formed thereon, the second section being receivable within the cleaning port of the firearm;

a spring-biased pin disposed within a bore formed in the second section, the spring-biased pin being receivable within the aperture, the bore further comprising a threaded section for receiving a set screw, a first unthreaded section and a second unthreaded section of lesser peripheral dimension than the first unthreaded section, the first unthreaded section being disposed intermediate the threaded section and the second unthreaded section, and wherein the spring-biased pin further comprises a first portion slidably disposed within the first unthreaded section and a second portion slidably disposed within the second unthreaded section, the first portion being of lesser longitudinal dimension than the first unthreaded section, the spring-biased pin being biased in an extended position by a spring disposed within the first unthreaded section between the set screw and the first portion; and a plurality of threaded bores formed around the periphery of the hollow section for receiving a retaining set screw, each retaining set screw frictionally engageable to the handle when the handle is disposed within the hollow section.

* * * * *